US005795173A

United States Patent [19]

Werner et al.

[11] Patent Number: 5,795,173

[45] Date of Patent: Aug. 18, 1998

[54] PLUG CONNECTOR

[75] Inventors: Thomas Werner, Maulburg; Markus Mornhinweg, Gundelfingen; Andreas Weber, Lörrach; Burkhard Lutterbeck, Steinen, all of Germany

[73] Assignee: Endress + Hauser GmbH + Co., Maulburg, Germany

[21] Appl. No.: 721,473

[22] Filed: Sep. 27, 1996

[30] Foreign Application Priority Data

Sep. 29, 1995 [EP] European Pat. Off. ..... 95115395

[51] Int. Cl.[6] ..... H01R 13/52

[52] U.S. Cl. ..... 439/275; 439/364; 439/271

[58] Field of Search ..... 439/275, 271, 439/272, 277, 274, 682, 690, 364, 374, 680

[56] References Cited

U.S. PATENT DOCUMENTS

| | | | |
|---|---|---|---|
| 2,824,290 | 2/1958 | Archer et al. | 439/275 |
| 3,699,499 | 10/1972 | Spaderna | 439/275 |
| 3,701,085 | 10/1972 | Graddy et al. . | |
| 3,963,297 | 6/1976 | Panek et al. | 439/275 |
| 4,443,052 | 4/1984 | Eaby et al. | 439/374 |
| 4,474,419 | 10/1984 | Konoshima | 439/678 |
| 4,568,145 | 2/1986 | Colin et al. . | |
| 4,974,075 | 11/1990 | Nakajima | 439/610 |
| 5,318,457 | 6/1994 | Harting et al. | 439/352 |
| 5,336,116 | 8/1994 | Boteler | 439/690 |

FOREIGN PATENT DOCUMENTS

| | | |
|---|---|---|
| 0 073 023 | 3/1983 | European Pat. Off. . |
| 0 161 910 | 11/1985 | European Pat. Off. . |
| 43 650 | 7/1983 | Germany . |
| 3838665 | 10/1989 | Germany . |
| 4 002 244 | 5/1991 | Germany . |
| 4 205 960 | 9/1993 | Germany . |
| 44 12 000 | 7/1994 | Germany . |
| 9408661 U | 9/1994 | Germany . |
| 2213066 | 8/1990 | Japan . |

*Primary Examiner*—Gary F. Paumen
*Assistant Examiner*—Tho Dac Ta
*Attorney, Agent, or Firm*—Bose McKinney & Evans

[57] ABSTRACT

A plug connector is provided, in particular for the connection of measuring instruments, which is to be connected to a plug having three flat elongated contact pins, a flat elongated protective contact pin and a threaded hole arranged in its center. The plug connector has a low maximum cross-sectional area and a high tightness. The plug connector has a housing (1) partly forming a cone (11), a hollow cylinder (12) which is molded onto the cone (11) on the side facing away from the plug and has an external thread (121), a nut (5) screwed onto the hollow cylinder (12), and a sealing element (4) which completely fills the hollow cylinder (12) and the nut (5). A four-way cable (3) penetrates the nut (5) and the sealing element (4) in the axial direction. A groove (14) is arranged on the side of the housing (1) facing toward the plug to accommodate a seal (6) and a ring (15) is molded on the cone (11) on the side facing toward the plug and encloses the plug coaxially at the end. A contact insert (2) is arranged in the housing (1), in which four flat contact clamps, to which the ways of the cable (3) are connected, are arranged in a countersunk fashion. The contact insert has a central axial hole (27) in which a screw (7) for securing the plug connector on the plug is captively arranged, and which is fixed nonrotably in the housing (1) by a bayonet closure and a locking tab (17) arranged in the housing (1) and can be detached only by a tool.

5 Claims, 2 Drawing Sheets

PLUG CONNECTOR

BACKGROUND OF THE INVENTION

The invention relates to a plug connector, which is to be connected to a plug having three flat elongated contact pins, a flat elongated protective contact pin and a threaded hole arranged in its center.

Plugs having three flat elongated contact pins, a flat elongated protective contact pin and a threaded hole arranged in its center are commercially available components, also known under the designation "solenoid valve plug", which are manufactured and used in large numbers.

The field of use for these plug connectors is correspondingly varied. They are used, in particular, for the connection of measuring instruments, for example pressure, filling level or flow measuring instruments, which have a corresponding plug.

DESCRIPTION OF THE PRIOR ART

In DE-C 44 12 000 a plug, in particular for the electrical connection of vehicle trailers, is described, which comprises:

- a bayonet ring for the detachable connection of the plug to a socket,
- a contact insert with contact pins which is arranged rotatably in the bayonet ring,
- a shoulder ring which is molded onto the contact insert and extends radially outward into a groove in the bayonet ring,
- an inner sleeve which is molded onto the contact insert on the side facing toward the socket and runs coaxially to the bayonet ring,
- a hollow cylinder, which is molded onto the contact insert on the side facing away from the socket, runs coaxially to the bayonet ring and has an external thread,
- a nut screwed onto the hollow cylinder,
- a sealing element filling the nut and a portion of the hollow cylinder facing away from the socket, and
- a cable penetrating the nut and the sealing ring in the axial direction.

One disadvantage of such a plug is that the plug and socket are connected to each other by means of a bayonet closure. Such a closure offers no special protection against the penetration of dust or moisture. Since the contact insert is arranged rotatably in the bayonet ring, there are additional gaps through which, for example, penetrating moisture can get into the entire internal space of the plug.

In the German Standard DIN 43 650: "Plug connectors, square shape", a plug connector is described which is to be connected to a plug having three flat elongated contact pins, a flat elongated protective contact pin and a threaded hole arranged in its center, which plug connector comprises:

- a housing,
  - having a first housing section which runs coaxially to the longitudinal axis of the plug and has a through central axial hole, in which there is arranged a screw for securing the plug connector on the plug, and
  - having a second housing section running at right angles to the first housing section,
- a four-way cable penetrating the first and the second housing section,
- a seal arranged on the side of the first housing section facing toward the plug and

- a contact insert arranged in the first housing section,
  - in which four flat contact clamps, to which the ways of the cable are connected, are arranged in a countersunk fashion,
  - which has a through central axial hole penetrated by the screw and
  - which is fixed in the first housing section by the screw.

In the case of this plug connector, because of the securing of the plug connector on the plug by means of a screw led through the first housing section, it is necessary for the second housing section, through which the cable is led, to extend at right angles to the first housing section. However, measuring instruments are often used at measurement locations at which only limited space for the plug connector is available. A cross-sectional area of the plug connector which is enlarged by the second housing section has a disadvantageous effect here.

In the case of such plug connectors, provision is normally made to arrange a sealing element on the contact insert on its side facing toward the plug. However, gaps remain both between the contact insert and the first housing section and between the screw and the first housing section, through which gaps, for example, dust and moisture can penetrate into the plug connector.

However, measuring instruments are often used in areas in which they must satisfy high safety requirements, in particular in relation to protection against the penetration of dust and moisture.

SUMMARY OF THE INVENTION

It is an object of the invention to specify a plug connector, in particular for the connection of measuring instruments, which is to be connected to a plug having three flat elongated contact pins, a flat elongated protective contact pin and a threaded hole arranged in its center, which connector has a low maximum cross-sectional area and a high tightness.

To this end, the invention comprises a plug connector which is to be connected to a plug having three flat elongated contact pins, a flat elongated protective contact pin and a threaded hole arranged in its center, which plug connector comprises:

- a housing partly forming a cone,
- a hollow cylinder which is molded onto the cone on the side facing away from the plug and has an external thread,
- a nut screwed onto the hollow cylinder,
- a sealing element which completely fills the hollow cylinder and the nut,
- a four-way cable which penetrates the nut and the sealing element in the axial direction,
- a groove, arranged on the side of the housing facing toward the plug, to accommodate a seal,
- a ring which is molded on the cone on the side facing toward the plug and encloses the plug coaxially at the end, and
- a contact insert arranged in the housing,
  - in which four flat contact clamps, to which the ways of the cable are connected, are arranged in a countersunk fashion,
  - which has a central axial hole in which a screw for securing the plug connector on the plug is captively arranged, and
  - which is fixed nonrotatably in the housing by means of a bayonet closure and a locking tab arranged in the housing and can be detached only by means of a tool.

According to a refinement of the invention, the housing has at least one pin which is molded on at the end on the side facing toward the plug and engages into an opening arranged in the plug.

According to a further refinement of the invention, the housing consists of a transparent, chemically highly resistant plastic, in particular of polyacrylsulfone.

According to a development of the invention, in the interior of the housing there is molded on at least one light guide whose first end adjoins the plug and whose second end adjoins a portion of the housing which is of thin-walled design.

According to a further refinement of the invention, the ring that is molded on the cone has an edge running around in its interior. The seal is fixed in the groove by the edge of the ring.

One advantage of the invention is that the screw, with which the plug connector is to be secured on the plug, is arranged in the interior of the housing. As a result there are between the external space and the internal space of the housing no additional gaps through which, for example, dust or moisture can penetrate. After the securing of the plug connector on the plug, the screw is not visible to the user.

A further advantage is that the housing is partly of conical design. As a result, the maximum cross-sectional area of the plug connector is virtually equal to the cross-sectional area of the plug.

A further advantage is that the housing is sealed in a dusttight and watertight manner, on the side facing toward the plug by the seal and the ring coaxially enclosing the plug and on the side facing away from the plug by the sealing element.

A further advantage is that, when securing the plug connector, no rotation of the plug connector about its longitudinal axis in relation to the plug is necessary. During assembly, such a rotation could lead to difficulties since, in the process, the seal could be thrown out, deformed or displaced, as a result of the friction occurring, the tightness being impaired thereby.

BRIEF DESCRIPTION OF THE DRAWINGS

The invention and further advantages will now be explained in more detail with reference to the figures of the drawing, in which an exemplary embodiment is shown; identical parts are provided with identical reference symbols in the figures.

DESCRIPTION OF THE PREFERRED EMBODIMENT

Figure 1:
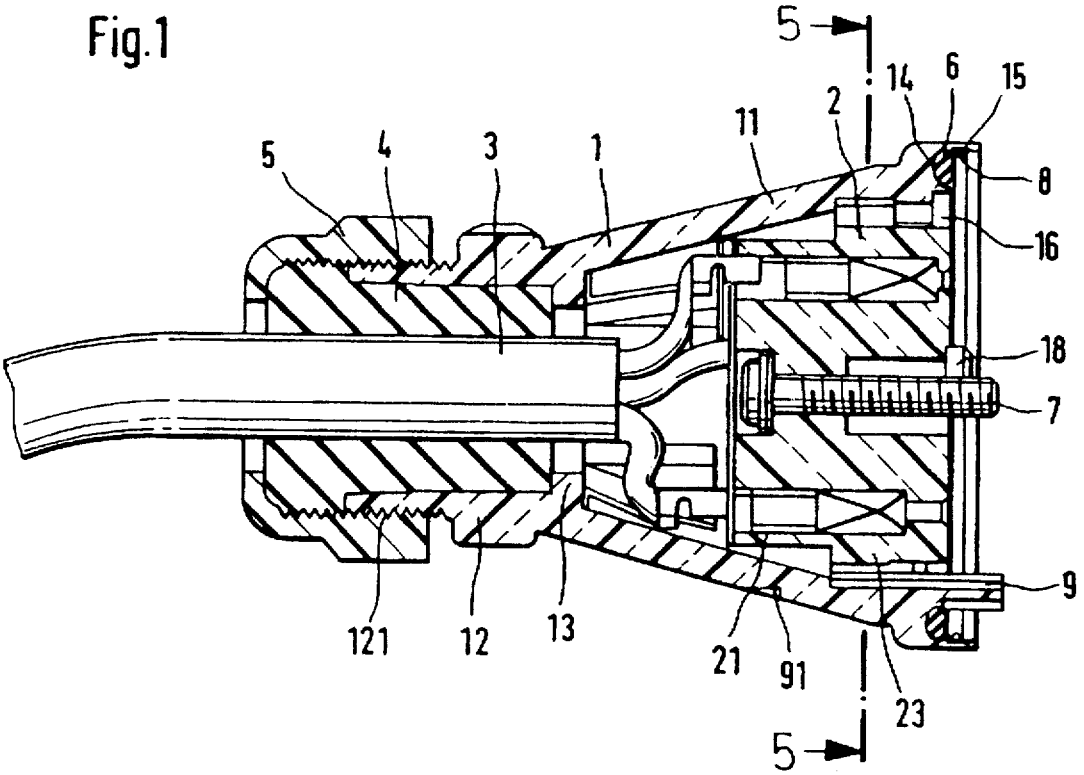
FIG. 1 shows a longitudinal section through a plug connector.

Shown in FIG. 1 is a longitudinal section of an exemplary embodiment of a plug connector. It is to be connected to a plug having three flat elongated contact pins, a flat elongated protective contact pin and a threaded hole arranged in its center.

The plug connector has a housing 1, which comprises a cone 11 and a hollow cylinder 12 which is molded on that end of the cone 11 facing away from the plug and having the smaller cross-sectional area. An external thread 121 is molded on the free end of the hollow cylinder 12.

At the height of the connecting point of cone 11 and hollow cylinder 12, the housing 1 has a shoulder 13 extending radially into the interior of the housing. Located in the hollow cylinder 12 is a cylindrical sealing element 4, which projects somewhat out of the hollow cylinder 12. A nut 5, which is to be screwed onto the external thread 121 of the hollow cylinder 12, is to be pushed over the sealing element 4.

The nut 5 and the sealing element 4 are penetrated in the axial direction by a four-way cable 3. The cavity existing in this housing section is thus completely filled by the sealing element 4. When the nut 5 is screwed on, the end region of the hollow cylinder 12 is pressed radially inward and thus pressed in a sealing fashion against the cable 3.

A groove 14 for accommodating a seal 6 is arranged on an annular surface of the cone 11 facing toward the plug. This seal is, for example, a molded seal or an O ring made of an elastomer.

On the side facing toward the plug, the cone 11 ends with a ring 15 which is molded on its outer annular surface and extends in the axial direction. Said ring coaxially encloses the plug, which is not shown in FIG. 1, at the end. This achieves the situation that spray water flows away on the outside of the housing 1 and cannot even get as far as the seal 6 at all.

The ring 15 has an edge B running around in its interior, the seal 6 is fixed in the groove 14 by the edge 8. This has the effect of a simplification during the assembly of the plug connector.

The housing 1 consists of a transparent, chemically highly resistant plastic, in particular of polyacrylsulfone.

A contact insert 2 is arranged in the housing 1. This insert is, for example, a plastic element which is produced by injection molding, for example of polyacrylsulfone.

In the exemplary embodiment shown, the housing 1 has a round cross section. However, all the features and properties mentioned apply to the same extent to a housing which, on the side facing toward the plug, has a rectangular or square cross section. In the case of such a housing, only the groove 14, the ring 15 and the seal 6 are to be replaced in a corresponding rectangular fashion.

Figure 2:
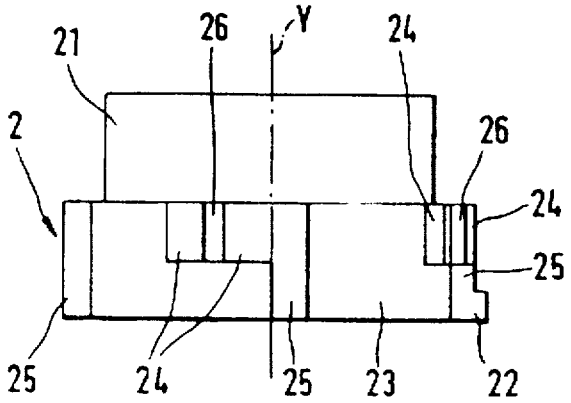
FIG. 2 shows a side view of the contact insert.

Shown in FIG. 2 is a side view of the contact insert 2. This comprises a cylinder 21 and a bayonet ring 23.

Figure 3:
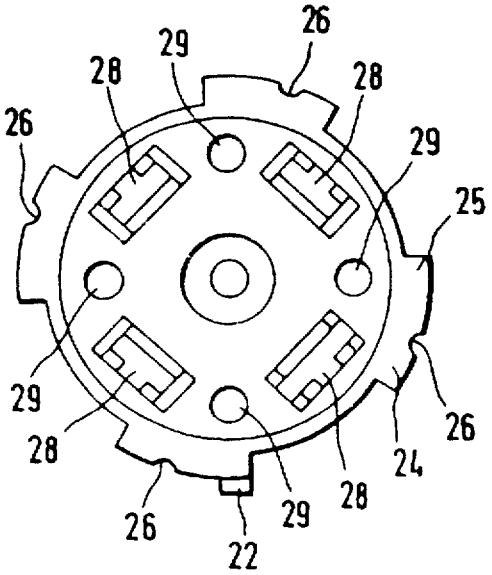
FIG. 3 shows a top view of the contact insert from the side facing away from the plug.

Shown in FIG. 3 is a top view of the contact insert 2 from its side facing away from the plug, this view showing the bayonet ring 23. The latter has four closure elements, each of which consists of an acute-angled ring segment 24 which is molded onto the bayonet ring 23 and runs at right angles to the axis of symmetry Y of the contact insert 2, and a stop 25 which is adjacent thereto and extends parallel to the axis of symmetry Y. Each ring segment 24 has on the outside a groove 26 running parallel to the axis of symmetry Y.

On one of the stops 25, on its side facing away from the ring segment, there is molded at the end a shoulder 22 extending radially outward. The housing 1 has on the side facing toward the plug a corresponding recess 16 for accommodating the shoulder 22, cf. FIG. 1. As a result, there is the same orientation of the contact insert 2 in the housing 1 in the case of each installation.

Figure 4:
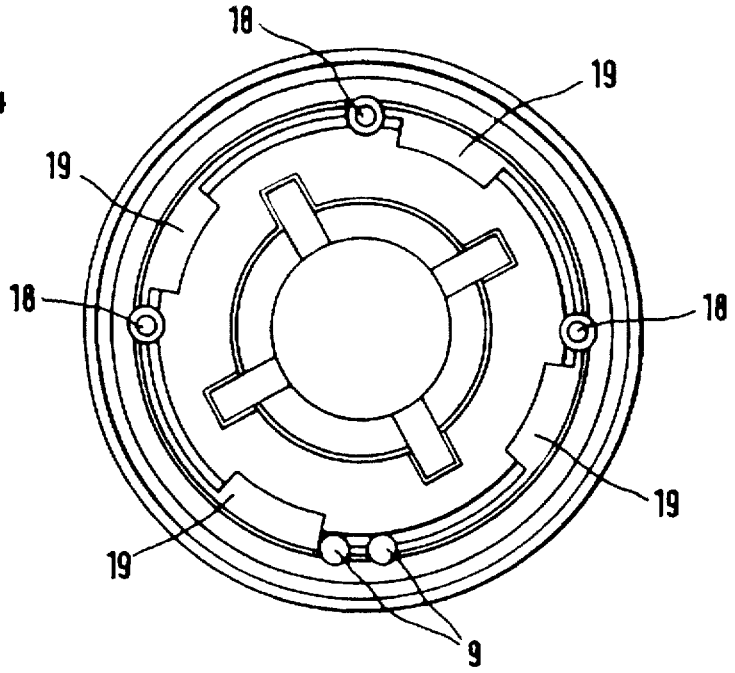
FIG. 4 shows a front view of the housing from the side facing toward the plug.
Figure 5:
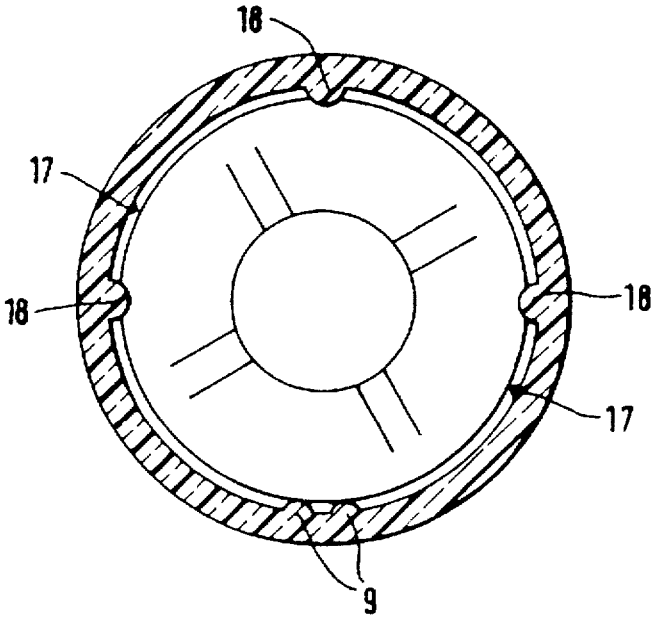
FIG. 5 shows a section through the housing along the line A—A of FIG. 1

The mating piece of the bayonet ring 23 in the housing 1 is shown in FIG. 4 and comprises four acute-angled ring segments 19 molded on the housing inner wall in one plane. Adjacent to two opposite ring segments 19 of the four ring segments 19, on their side facing away from the plug, there is in each case molded a locking tab 17 running in the axial direction in the housing 1, as is shown in FIG. 5.

The contact insert 2 is intended to be inserted into the housing 1 and then to be turned, with the result that the bayonet ring 23 rests with the ring segments 24 on the ring segments 19 of the housing 1 and the stops 25 bear on the ring segments 19. In this arrangement, both the locking tabs 17 engage into the two corresponding, mutually opposite grooves 26. The contact insert 2 is thus fixed and no longer rotatable. It can be detached again only by means of a tool.

Furthermore, the contact insert 2 has four through holes 29, shown in FIG. 3. A corresponding tool, for example a four-pronged fork, can be placed into these, with which tool the contact insert 2 can be rotated in the housing 1 and removed from the housing 1. This offers protection against improper or unauthorized manipulation, in particular transposition of the connections.

Figure 6:
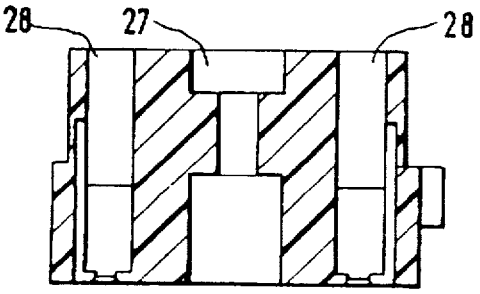
FIG. 6 shows a longitudinal section through the contact insert.

FIG. 6 shows a longitudinal section through the contact insert 2. It has a central axial through hole 27 to accommodate a screw 7. This hole 27 has a central portion with a small diameter. When the screw 7 is first screwed in, it cuts a thread into this portion and, after screwing in, the thread of the screw 7 is located on the side of this central portion facing the plug. By this means, the screw 7 is retained captively in the contact insert 2.

Arranged in a circle around the hole 27 are four axial holes 28 of rectangular cross sections. Flat contact clamps are countersunk in these holes 28. The ways of the cable 3 are provided with corresponding flat connectors and are plugged into the flat contact clamps on the side facing away from the plug.

The plug connector is assembled, by first connecting the ways of the cable 3 to the contact insert 2. Then, the housing 1 is to be led over the contact insert 2 and the cable 3 and the bayonet closure is to be closed. The plug connector is then to be fastened on the plug, not shown in the figures, by means of the screw 7. The screw fixing is carried out through the opening of the housing 1 facing away from the plug. As a result of the insertion of the contact pins of the plug into the flat contact clamps in the contact insert 2, rotation of the plug connector about its longitudinal axis in relation to the plug is prevented. Therefore, during the assembly the seal 6 is neither rotated nor thrown out, but only compressed. Finally, the sealing element 4 is to be pushed onto the cable 3 and the nut 5 is to be assembled.

In this exemplary embodiment, the housing 1 has three pins 18, which are molded on at the end on the side facing the plug and are shown in FIG. 1 and in FIG. 4. These pins engage in corresponding openings to be arranged in the plug. The pins 18 effect an additional protection against rotation of the plug connector about its longitudinal axis in relation to the plug. Such a rotation can occur in the case of housings of round cross section, for example if the contact pins are not firmly clamped into the flat contact clamps.

Two light guides 9 can be molded on in the inner wall of the cone 11. A first end of the light guides 9 adjoins the plug. A second end of the light guides 9 adjoins a section 91 of the housing 1, which is of thin-walled design. Just like the housing 1, the light guides consist of polyacrylsulfone. The light guides 9 serve to guide light, for example from a light-emitting diode arranged on the plug, so that it is possible to detect through the plug connector whether or not the light-emitting diode is switched on. Such a light-emitting diode is used in measuring instruments, for example for the purpose of indicating the operating state of the measuring instrument, for example on/off, or of indicating an alarm.

We claim:

1. A plug connector which is to be connected to a plug having three flat elongated contact pins, a flat elongated protective contact pin and a threaded hole arranged in its center, which plug connector comprises:

a housing (1) partly forming a cone (11), a hollow cylinder (12) which is molded onto the cone (11) on the side facing away from the plug and has an external thread (121), a nut (5) screwed onto the hollow cylinder (12), a sealing element (4) which completely fills the hollow cylinder (12) and the nut (5), a four-way cable (3) which penetrates the nut (5) and the sealing element (4) in the axial direction, a groove (14), arranged on the side of the housing (1) facing toward the plug, to accommodate a seal (6), a ring (15) which is molded on the cone (11) on the side facing toward the plug and which encloses the plug coaxially at the end, and retains the seal (6) in the groove (14) and a contact insert (2) arranged in the housing (1), in which four flat contact clamps, to which the ways of the cable (3) are connected, are arranged in a countersunk fashion, which has a central axial hole (27) in which a screw (7) for securing the plug connector on the plug is captively arranged, and which is fixed nonrotatably in the housing (1) by means of a bayonet closure and a locking tab (17) arranged in the housing (1) and can be detached only by means of a tool.

2. The plug connector as claimed in claim 1, in which the housing (1) consists of a transparent, chemically highly resistant plastic, in particular of polyacrylsulfone.

3. The plug connector as claimed in claim 1, in which the ring (15) that is molded onto the cone (11) has an edge (8) running around in its interior the seal (6) is fixed in the groove (14) by the edge (8).

4. The plug connector as claimed in claim 1, in which the housing (1) has at least one pin (18) which is molded on at the end on the side facing toward the plug and engages into an opening arranged in the plug.

5. The plug connector as claimed in claim 4, in which, in the interior of the housing (1), there is molded on at least one light guide (9) whose first end adjoins the plug and whose second end adjoins a portion (91) of the housing (1) which is of thin-walled design.

* * * * *